US007562914B2

(12) United States Patent
Bassi

(10) Patent No.: US 7,562,914 B2
(45) Date of Patent: Jul. 21, 2009

(54) HANDLE OPENING DEVICE FOR A DOOR OF AN ELECTRIC HOUSEHOLD APPLIANCE, IN PARTICULAR A REFRIGERATOR OR FREEZER

(75) Inventor: Alberto Bassi, Turin (IT)

(73) Assignee: ITW Industrial Components S.R.L., Milan (IT)

( * ) Notice: Subject to any disclaimer, the term of this patent is extended or adjusted under 35 U.S.C. 154(b) by 0 days.

(21) Appl. No.: 11/257,019

(22) Filed: Oct. 25, 2005

(65) Prior Publication Data

US 2006/0087131 A1 Apr. 27, 2006

(30) Foreign Application Priority Data

Oct. 26, 2004 (IT) ..... TO2004A0736

(51) Int. Cl.
*E05C 1/12* (2006.01)

(52) U.S. Cl. ..... 292/173; 292/254; 292/DIG. 30; 292/DIG. 71

(58) Field of Classification Search ..... 292/173, 292/253, 254 X, DIG. 4, DIG. 15, DIG. 17, 292/DIG. 26, DIG. 30 X, DIG. 37, DIG. 71 X, 292/216, 336.3, 347; 49/276–278, 364, 379; 312/405

See application file for complete search history.

(56) References Cited

U.S. PATENT DOCUMENTS 2,659,115 A * 11/1953 Anderson et al. ..... 49/277
4,003,593 A * 1/1977 Wilzig et al. ..... 292/92
5,085,474 A * 2/1992 Toledo et al. ..... 292/92
5,782,114 A * 7/1998 Zeus et al. ..... 70/109
5,783,114 A * 7/1998 Dyer et al. ..... 252/582
5,908,228 A * 6/1999 Lee ..... 312/405

FOREIGN PATENT DOCUMENTS

EP 0598979 6/1994
JP 61-079976 A * 4/1986

* cited by examiner

*Primary Examiner*—Peter M. Cuomo
*Assistant Examiner*—Mark Williams
(74) *Attorney, Agent, or Firm*—Lowe, Hauptman, Ham & Berner, LLP

(57) ABSTRACT

An opening device with a handle for a door of an electric household appliance, which door rotates about a hinge axis between an open position, and a closed position wherein the door rests, with the interposition of a peripheral seal, against a front edge of a door opening of the electric household appliance; the device includes: a support fixed to the door, close to the front edge of the door opening; the handle, which is fitted to the support to rock in opposition to elastic elements, so as to be positioned, in use, to the front of the door and at a predetermined distance from an outer surface of the door; and elements which, in use, exert thrust on the front edge of the door opening to detach the door from the door opening and rotate it into the open position, when the handle is rotated towards the outer surface of the door, so as to open the door by pushing on the handle; an optional spring completes rotation of the door about the hinge axis.

5 Claims, 2 Drawing Sheets

HANDLE OPENING DEVICE FOR A DOOR OF AN ELECTRIC HOUSEHOLD APPLIANCE, IN PARTICULAR A REFRIGERATOR OR FREEZER

The present invention relates to a handle opening device for a door of an electric household appliance, in particular a refrigerator or freezer, having means for assisting opening of the door.

In the closed position, the door of an electric household appliance, in particular a refrigerator or freezer, rests against a front edge of the door opening, normally with the interposition of a peripheral seal; and, to free the door opening to permit access inside the appliance, the door rotates about a normally vertical hinge axis into an open position.

BACKGROUND OF THE INVENTION

EP-B-0598979 describes a toggle-handle device for opening the door of an electric household appliance, in this case a refrigerator or freezer, and which, when the door is in the closed position, assists the user in opening the door by exerting thrust on the front edge of the door opening, when the handle is pulled manually, in opposition to first elastic means acting on the handle. This device mainly serves to reduce the effort required of the user to open the door, particularly when adhesion of the door to the front edge of the door opening is increased, for example, by the formation of frost.

The above device has various drawbacks. In particular, it is complex in design, expensive, and relatively bulky, also on account of the presence of second elastic means which act on a rod controlled by rotation of the handle. Moreover, to open the door, the user must pull on the handle, which is not always convenient, especially if the user's hands are full, e.g. with foodstuffs for storage in the refrigerator or freezer. In fact, to activate the opening device, the handle must normally be gripped firmly, which takes at least one hand.

SUMMARY OF THE INVENTION

It is an object of the present invention to eliminate the drawbacks of the above known device by providing a toggle-handle device for opening the door of an electric household appliance, in particular a refrigerator or freezer, which provides for low-cost production and assembly, compactness, and reliability, both of the device itself and the electric household appliance as a whole, and which permits even no-handed opening of the door by the user.

The present invention therefore relates to an opening device with a handle for a door of an electric household appliance, which door rotates about a hinge axis between an open position, and a closed position wherein the door rests, with the interposition of a peripheral seal, against a front edge of a door opening of the electric household appliance; the device comprising a support fixed to the door, close to said front edge of the door opening; said handle, which is fitted to the support to rock, in opposition to elastic means, between a rest position and a release position, and which, in the rest position, is positioned, in use, to the front of the door and at a predetermined distance from an outer surface of the door; and push means which, in use, cooperate with and exert thrust on said front edge of the door opening to detach the door from the door opening and rotate it into the open position; characterized in that said push means are activated by rotation of the handle towards the outer surface of the door, so that the door is opened, in use, by the user pushing, as opposed to pulling, on the handle.

More specifically, the opening device according to the invention comprises a support fixed to the door, close to a front edge of the door opening; a handle fitted to the support to rock, in opposition to elastic means, between a rest position and a release position, and which, in the rest position, is located to the front of the door, at a predetermined distance from an outer surface of the door; and push means which, in use, cooperate with and exert thrust on the front edge of the door opening to detach the door from the door opening and rotate the door into the open position. According to the invention, the push means are activated by rotation of the handle towards the outer surface of the door, so that, in use, the door is opened by the user pushing, as opposed to pulling, on the handle.

In a first embodiment, the handle is L-shaped and comprises a first and a second arm; the first arm defines the grip of the handle, while the push means are defined by the second arm, which projects from the swing axis of the handle on the opposite side to the first arm and, in use, towards the front edge of the door opening, and has a stick-out length greater than the total thickness of the door and relative peripheral seal, so as to cooperate, in use, with the front edge of the door opening to open the door when the handle is in the release position.

For this purpose, the elastic means normally keep the handle in the rest position, with the second arm rotated, with respect to the perpendicular to the outer surface of the door, on the side facing the first arm and forming, in use, such an angle with the door that the projection of the second arm measured along the perpendicular to the outer surface of the door is roughly equal in length to the total thickness of the door and peripheral seal.

Consequently, when the handle is rotated into the release position, by pushing as opposed to pulling the handle, given the way in which it is connected, the first arm moves gradually towards the outer surface of the door, and the second arm gradually reduces the angle formed with the perpendicular to the outer surface of the door, and, given the length of the second arm, detaches the door from the door opening.

In a second embodiment, the handle is V-shaped, with a longer first arm shaped to define the grip, and a shorter second arm projecting from the swing axis, on the opposite side to the first arm; and the push means comprise a rod connected in articulated manner, by pin-and-slot means, to a free end of the second arm of the handle.

In both the above embodiments, the device is therefore compact, reliable, and relatively cheap, also on account of only requiring elastic means to oppose the rocking movement of the handle, and, above all, of detaching the door, in opposition to the door retaining means (e.g. magnets), by the user simply pressing or pushing, as opposed to pulling, on the handle.

The handle is much easier to push than to pull by the user, and, in particular, need not be gripped, and may be pushed with the elbow or other parts of the body, and therefore with both hands full. The door may then be opened completely using a foot, or by a spring on the axis of rotation of the door.

Moreover, appropriately sizing the length of the arms of the handle also produces a "lever" effect to increase the thrust exerted by the user on the handle, thus assisting opening of the door in the event normal retention by the retaining means (e.g. magnets) is increased, for example, by the formation of frost on the seal.

BRIEF DESCRIPTION OF THE DRAWINGS

Two non-limiting embodiments of the present invention will be described by way of example with reference to the accompanying drawings, in which.

DETAILED DESCRIPTION OF THE INVENTION

Figure 1:
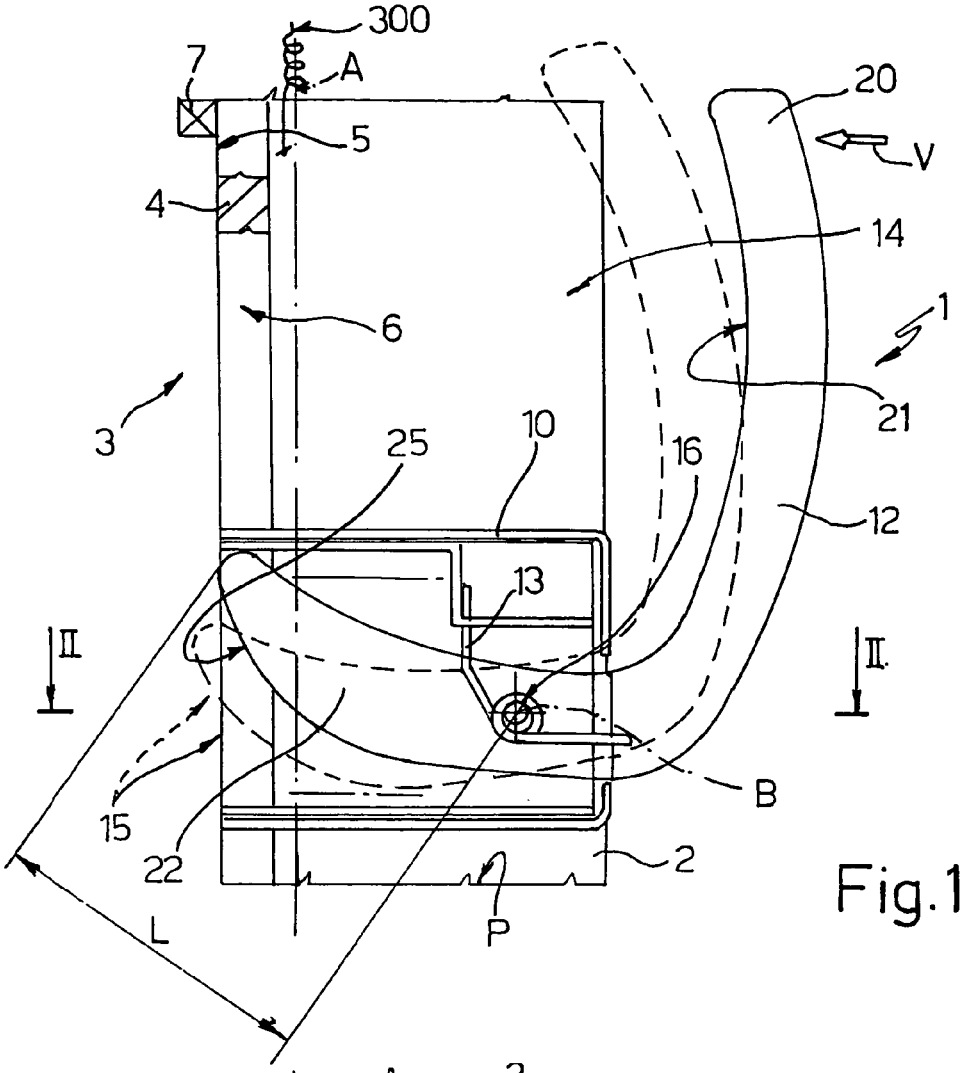
FIG. 1 shows a side view of a refrigerator door featuring an opening device in accordance with the invention.
Figure 2:
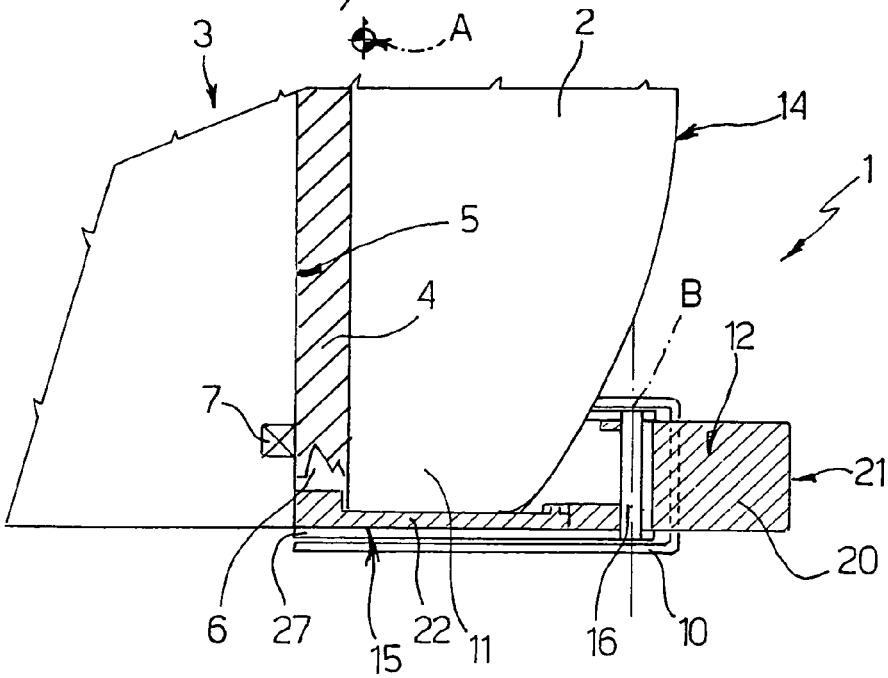
FIG. 2 shows a section along line II-II of the FIG. 1 device fitted to the door.

Number 1 in FIGS. 1 and 2 indicates as a whole a handle opening device for a door 2 of an electric household appliance 3—in the example shown, a refrigerator; which door 2 rotates, about a hinge axis A (shown schematically in FIGS. 1 and 2), between a closed position (shown in FIGS. 1 and 2), wherein door 2 rests, with the interposition of a known peripheral seal 4 (shown schematically), against a front edge 5 of a door opening 6 of appliance 3, and an open position (not shown for the sake of simplicity), wherein door 2—in the example shown, together with seal 4 which is normally integral with door 2—is detached from front edge 5 of door opening 6 by an amount sufficient to disable the retaining means holding door 2 in the closed position and normally defined by magnets 7 possibly incorporated in seal 4.

Device 1 comprises a support 10 fixed to door 2, close to front edge 5 of door opening 6—in the example shown, astride a peripheral lateral edge 11 of door 2 on the opposite side to axis A; and a handle 12 fitted to support 10 to rock, in opposition to known elastic means 13, between a rest position, shown by the continuous line in FIG. 1, and a release position, shown by the dash line in FIG. 1.

In the rest position, handle 12 is located, in use, to the front of door 2, at a predetermined distance from an outer surface 14 of door 2.

Device 1 also comprises push means 15 which, in use, cooperate with and exert thrust on front edge 5 of door opening 6 to detach door 2 from door opening 6 and rotate it about axis A into the open position.

According to the invention, push means 15 are designed to act on front edge 5 when handle 12 is rotated into the release position in a direction V (shown by the arrow in FIG. 1) towards surface 14 (which, in the example shown, is appropriately rounded (FIG. 2) to permit relatively ample rotation of handle 12), so that, in use, door 2 is opened by the user pushing handle 12 in the direction of arrow V, as opposed to pulling the handle, as is normally the case.

In the embodiment shown, handle 12 rotates, in opposition to elastic means 13, about a swing axis B defined, for example, by a pin 16 parallel to the plane of door 2 and preferably substantially perpendicular to hinge axis A of door 2.

Handle 12 is L-shaped and comprises a first arm 20 shaped to define a grip 21 positioned, in use, facing door 2 and located at said predetermined distance from outer surface 14 of door 2 when handle 12 is in the rest position. A second arm 22 of handle 12 projects from swing axis B, on the opposite side to arm 20 and, in use, towards front edge 5, and has a stick-out length L greater than the total thickness of door 2 and peripheral seal 4. For this reason, and also because of its particular shape, arm 22 defines push means 15, by cooperating, in use, as will be seen, with front edge 5, both in the rest position of handle 12, and in the release position, in which it detaches door 2 from door opening 6.

In the example shown, elastic means 13 normally (i.e. in the non-deformed or preloaded position) keep handle 12 in the rest position, wherein second arm 22 (as shown by the continuous line in FIG. 1) forms, in use, such an angle with door 2 that the projection of arm 22, measured along a perpendicular P to door 2 (i.e. perpendicular to axis B), is roughly equal in length to the total thickness of door 2 and peripheral seal 4. In the rest position, arm 22 is also rotated, with respect to perpendicular P to door 2, on the side facing first arm 20—upwards in the FIG. 1 example.

Arm 22 is also shorter than arm 20, and has, on the opposite side to arm 20, a curved edge 25 facing front edge 5 in use.

Support 10 is in the form of a casing fitted astride peripheral lateral edge 11 of door 2; in the rest position, second arm 22 of handle 12 is in a withdrawn position inside support 10, as shown in FIGS. 1 and 2; and, in the release position, second arm 22 of handle 12 is in an extracted position projecting from casing 10 through an opening 27 (FIG. 2) on the opposite side to arm 20 defining grip 21.

In actual use, the user pushes grip 21, with any part of the body, in the direction of arrow V to overcome the resistance of elastic means 13; as a result, handle 12 is rotated towards surface 14 to gradually reduce the angle formed between arm 22 and the perpendicular to door 2; and arm 22, which normally already rests on front edge 5, is moved gradually into the extracted position shown by the dash line, wherein, given its length, it interferes with edge 5 to produce a reaction thrust which detaches door 2 from door opening 6. Being rounded towards edge 11, arm 20 does not interfere with surface 14; which effect may obviously also be achieved by positioning handle 12 at a suitable distance from surface 14.

Figure 3:
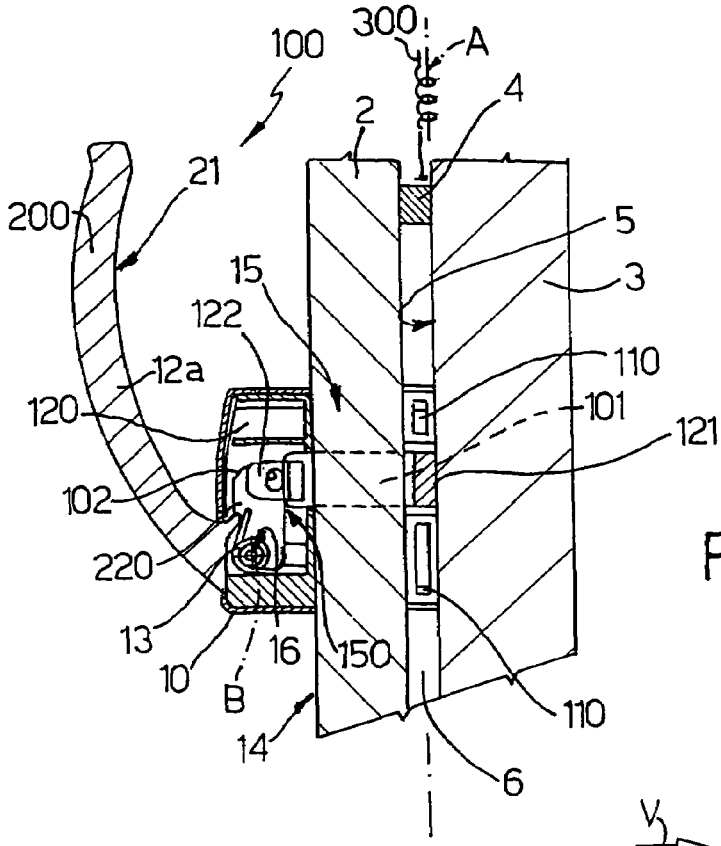
FIG. 3 shows a partly sectioned, schematic side view of a refrigerator door resting against a door opening and featuring a variation of the device according to the invention.
Figure 4:
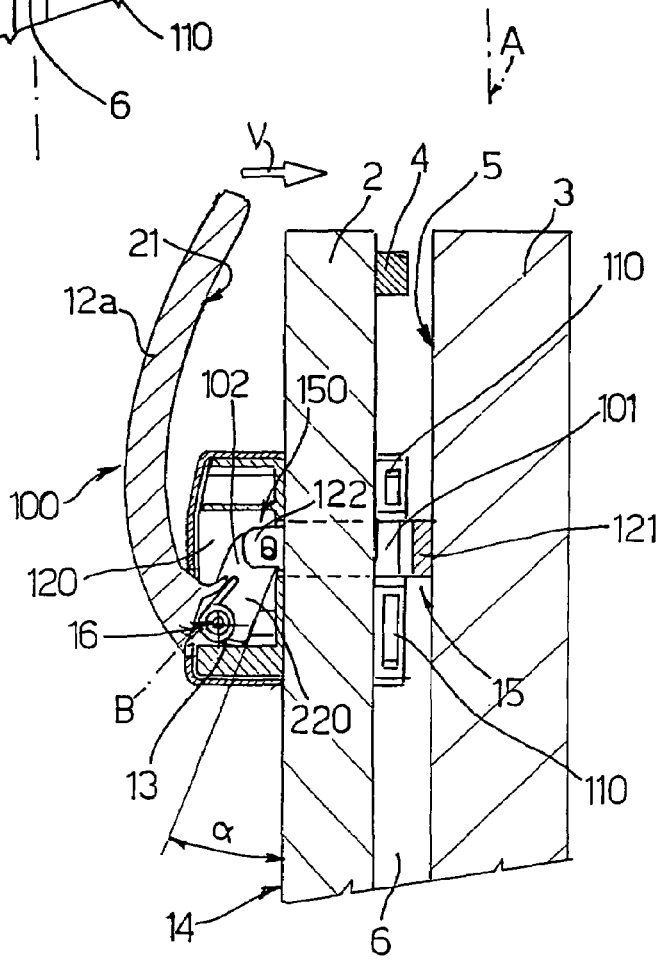
FIG. 4 shows the same view as in FIG. 3, but with the door detached from the door opening.

FIGS. 3 and 4 show a variation 100 of the device according to the invention, in which any details similar or identical to those already described are indicated using the same reference numbers for the sake of simplicity.

Device 100 comprises a handle **12*a* fitted to support 10 to rock in opposition to elastic means 13, as described relative to device 1. Handle 12*a* is substantially in the form of an asymmetrical V, and comprises a longer first arm 200 shaped to define a grip 21 positioned, in use, facing door 2 and at a predetermined distance from outer surface 14 of door 2 when handle 12*a* is in the rest position. A shorter second arm 220 of handle 12*a* projects from swing axis B, on the opposite side to arm 200**.

In this case, as opposed to one of the actual arms of the handle, push means 15 comprise a rod 101 connected in articulated manner to a free end 102 of arm 220 of handle **12*a*. Rod 101 is fitted to support 10 to slide between at least two guides 110 of support 10, which are arranged so that, in use, rod 101 slides, perpendicularly to front edge 5 of door opening 6, between a withdrawn position inside support 10 (FIG. 3), and an extracted position (FIG. 4) assumed when handle 12*a*** is in the release position.

Rod 101 is longer than the total thickness of door 2 and peripheral seal 4, and, when handle **12*a* is in the rest position, the portion of the rod exceeding the total thickness of door 2 and seal 4 is housed in support 10, inside an inner cavity 120 housing arm 220 and axis B with relative pin 16 and spring 13. Cavity 120 is located in a portion of support 10 projecting frontwards from surface 14, so that one end 121 of rod 101 rests, in use, in the withdrawn position, against front edge 5**.

Conversely, when handle 12*a* is in the release position, end 121 of rod 101 projects from support 10 and, in use, towards front edge 5 of door opening 6 by a sufficient amount to interfere with front edge 5 and so detach door 2 from front edge 5 and door opening 6.

In this case too, elastic means 13 normally keep handle 12*a* in the rest position, wherein second arm 220 keeps rod 101 in contact with front edge 5; and, when handle 12*a* is in the release position, second arm 220 is rotated, with respect to swing axis B of handle 12*a*, away from first arm 200.

Arm 220 is connected mechanically to rod 101 by a pin-and-slot-type articulated joint 150 housed inside cavity 120 and connecting the free end of arm 220 to an end 122, opposite end 121, of rod 101. Articulated joint 150 is designed to allow arm 220 to move, with respect to rod 101, in a direction perpendicular to the slide direction of rod 101—in the example shown, vertically.

By pushing grip 21 with any part of the body in the direction of arrow V, the user rotates grip 21 of handle 12*a* towards door 2, thus also rotating arm 220 towards surface 14 of door 2, and so sliding rod 101 forward between guides 110. Rotation of handle 12*a* in the opposite direction withdraws rod 101, all with no need for a second contrasting spring.

In both the embodiments described, the device according to the invention may be completed with a spring 300 acting on door 2 and located, for example, along axis A, and which is mounted so as to be preloaded, when door 2 is closed, to a force incapable of overcoming the retaining means, e.g. magnets, keeping door 2 closed. Consequently, when the device according to the invention detaches and partly rotates door 2 into the open position, by disabling the retaining means and pushing on handle 12 or 12*a* as described previously, spring 300, if provided, automatically completes the movement of door 2 into the fully-open position, with no need for any further intervention on the part of the user, thus making no-handed opening of door 2 even easier.

Handle 12 or 12*a* may obviously be connected to a known catch mechanism, instead of or in addition to the purely magnetic retaining means keeping door 2 closed, to release the catch mechanism before door 2 is detached from the door opening.

The invention claimed is:

1. An electric household appliance, comprising:

a door opening;

a door for closing the door opening; and an opening device for the door, said opening device comprising:

a support fixed to the door and adjacent a front edge of the door opening when the door is in a closed position;

a handle pivotably supported by the support to rock between a rest position and a release position;

an elastic element biasing said handle towards the rest position; and a pusher which, when activated in use, cooperates with and exerts thrust on said front edge of the door opening to detach the door from the door opening and to rotate the door in a first direction toward an open position;

wherein said pusher is activated by rotation of the handle from the rest position to the release position and towards the support and the door in a second direction opposite to the first direction, so that the door is opened, in use, by only pushing, as opposed to pulling, on the handle;

wherein said handle and pusher are integrated in a single element;

wherein said handle is rotatable about a swing axis substantially perpendicular to a hinge axis about which the door is rotatable between the open and closed positions.

2. An electric household appliance, comprising:

a door opening;

a door for closing the door opening; and an opening device for the door, said opening device comprising:

a support fixed to the door and adjacent a front edge of the door opening when the door is in a closed position;

a handle pivotably supported by the support to rock between a rest position and a release position;

an elastic element biasing said handle towards the rest position; and a pusher which, when activated in use, directly contacts and exerts thrust on said front edge of the door opening to detach the door from the door opening and to rotate the door;

wherein said pusher is activated by rotation of the handle from the rest position to the release position and towards the support and the door, so that the door is opened, in use, by only pushing, as opposed to pulling, on the handle;

wherein said opening device comprises a lever supported by the support so as to be rotatable about a swing axis, and comprising:

a first arm which defines said handle facing the door and positioned at a predetermined distance from the outer surface of the door when the handle is in said rest position; and a second arm which defines said pusher projecting from the swing axis away from the first arm and towards said front edge of the door opening, said pusher contacting and pressing on said front edge of the door opening when the handle is in the release position to push said door away from the front edge of the door opening, thereby pivoting said door toward the open position;

wherein said support is a casing fitted on a peripheral edge of the door;

when said handle is in said rest position, said second arm is completely withdrawn inside said casing; and when said handle is in said release position, said second arm projects outside said casing away from the handle.

3. An opening device for a door of an electric household appliance having a door opening closeable by the door, the opening device comprising:

a support adapted to be fixed to the door adjacent a front edge of the door opening when the door is in a closed position;

a handle pivotably supported by the support to rock between a rest position and a release position;

an elastic element biasing said handle towards the rest position; and a pusher which, when activated in use, is adapted to cooperate with and exert thrust on said front edge of the door opening to detach the door from the door opening and to rotate the door in a first direction toward an open position;

wherein said pusher is activated by rotation of the handle from the rest position to the release position and towards the support in a second direction opposite to the first direction, so that the door is opened, in use, by only pushing, as opposed to pulling, on the handle;

wherein said handle and pusher are integrated in a single element;

wherein said support is a casing housing therein the elastic element;

said opening device comprising a lever which is supported by the casing so as to be rotatable about a swing axis and comprises:

a first arm which defines said handle and projects through a front face of the casing to define a grip adapted to face the door and to be positioned at a predetermined distance from the outer surface of the door when the handle is in said rest position; and a second arm which defines said pusher projecting from the swing axis away from the first arm and towards a rear face of said casing;

wherein when said handle is in said rest position, said second arm is completely withdrawn inside said casing; and when said handle is in said release position, said second arm projects outside said casing through the rear face and away from the handle.

4. The opening device as claimed in claim 3, wherein, when said handle is in the rest position, a rearmost portion of said second arm is flush with a plane of the rear face of the casing.

5. In combination, a door of an electric household appliance having a door opening adapted to be closed by the door, and an opening device for the door, said opening device comprising:

a support fixed to the door and adapted to be adjacent a front edge of the door opening when the door is in a closed position;

a handle pivotably supported by the support to rock between a rest position and a release position;

an elastic element biasing said handle towards the rest position; and a pusher which, when activated in use, is adapted to cooperate with and exert thrust on said front edge of the door opening to detach the door from the door opening and rotate the door toward an open position;

wherein said handle and pusher are integrated in a single element;

said pusher is activated by rotation of the handle from the rest position to the release position and towards the support and the door, so that the door is opened, in use, by pushing, as opposed to pulling, on the handle;

said door defines a rear plane corresponding to a plane of the front edge of the door opening when the door is in the closed position;

when said handle is in the rest position, said pusher is completely located at a front side of said rear plane of the door; and when said handle is in the release position, said pusher projects from said front side, through said rear plane, to an opposite, rear side of said rear plane for contacting and pressing on the front edge of the door opening to push said door away from the front edge of the door opening, thereby pivoting said door toward the open position;

wherein said door comprises on a rear face thereof a peripheral seal which defines said rear plane of the door;

the handle being positioned to face a front face of the door;

said door being adapted to rest against the front edge of the door opening with said peripheral seal interposed therebetween when the door is in the closed position;

wherein said opening device comprises a L-shaped lever supported by the support so as to be rotatable about a swing axis and comprising:

a first arm which defines said handle facing the front face of the door and positioned at a predetermined distance from the front face of the door when the handle is in said rest position; and a second arm which defines said pusher projecting from the swing axis away from the first arm and towards the rear face of the door;

wherein, when said handle in said rest position, said second arm projects beyond the rear face of the door without projecting beyond said rear plane defined by the peripheral seal; and wherein the swing axis is located outside a corner portion of the L-shaped lever, thereby defining the second arm which is shorter than the first arm, the first arm is angled at the corner portion of the L-shaped lever.

* * * * *